US008923539B2

(12) United States Patent
Bren et al.

(10) Patent No.: US 8,923,539 B2
(45) **Date of Patent: *Dec. 30, 2014**

(54) INTEGRATED AUTOMATIC TELEPHONE SWITCH

(75) Inventors: Mark A. Bren, Lorretto, MN (US); Lawrence T. Hagen, Minnetonka, MN (US); Randall W. Roberts, Eden Prairie, MN (US); Timothy S. Peterson, Lino Lakes, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/601,694

(22) Filed: Aug. 31, 2012

(65) Prior Publication Data

US 2013/0108093 A1 May 2, 2013

Related U.S. Application Data

(63) Continuation of application No. 11/768,707, filed on Jun. 26, 2007, now Pat. No. 8,259,973, which is a continuation of application No. 10/284,877, filed on Oct. 31, 2002, now Pat. No. 7,248,713, which is a continuation-in-part of application No. 09/659,214, filed on Sep. 11, 2000, now Pat. No. 6,760,457.

(51) Int. Cl.
*H04R 25/00* (2006.01)

(52) U.S. Cl.
CPC ..... *H04R 25/453* (2013.01); *H04R 25/43* (2013.01); *H04R 2225/023* (2013.01); *H04R 25/558* (2013.01); *H04R 25/50* (2013.01); *H04R 2499/11* (2013.01); *H04R 25/554* (2013.01); *H04R 2225/61* (2013.01)
USPC ..... 381/317; 381/315

(58) Field of Classification Search
USPC ..... 381/312, 313, 315, 317–318, 320–321, 381/328–331
See application file for complete search history.

(56) References Cited

U.S. PATENT DOCUMENTS 2,530,621 A 11/1950 Lybarger
2,554,834 A 5/1951 Lavery (Continued)

FOREIGN PATENT DOCUMENTS

CH 670349 A5 5/1989
DE 2510731 A1 9/1976

(Continued)

OTHER PUBLICATIONS

U.S. Appl. No. 10/284,877, Final Office Action mailed Jun. 14, 2006, 11 pgs.

(Continued)

*Primary Examiner* — Davetta W Goins
*Assistant Examiner* — Phylesha Dabney
(74) *Attorney, Agent, or Firm* — Schwegman Lundberg & Woessner, P.A.

(57) ABSTRACT

Methods and apparatus for a hearing aid include a mechanism to detect the presence of a magnetic field using a magnetic sensing device disposed in a hearing aid, to digitally modify a frequency response of the hearing aid in response to the detection of the presence, and to modify the frequency response of the hearing aid in response to the magnetic sensing device determining removal of the magnetic field.

20 Claims, 5 Drawing Sheets

(56) References Cited

U.S. PATENT DOCUMENTS

| | | | | |
|---|---|---|---|---|
| 2,656,421 | A | 10/1953 | Lybarger | |
| 3,396,245 | A | 8/1968 | Flygstad | |
| 3,660,695 | A | 5/1972 | Schmitt | |
| 4,187,413 | A | 2/1980 | Moser | |
| 4,395,601 | A | 7/1983 | Kopke et al. | |
| 4,425,481 | A | 1/1984 | Mansgold et al. | |
| 4,467,145 | A | 8/1984 | Borstel | |
| 4,489,330 | A | 12/1984 | Marutake et al. | |
| 4,490,585 | A | 12/1984 | Tanaka | |
| 4,508,940 | A | 4/1985 | Steeger | |
| 4,596,899 | A | 6/1986 | Wojcik et al. | |
| 4,631,419 | A | 12/1986 | Sadamatsu et al. | |
| 4,638,125 | A | 1/1987 | Buettner | |
| 4,696,032 | A | 9/1987 | Levy | |
| 4,710,961 | A | 12/1987 | Buttner | |
| 4,756,312 | A | 7/1988 | Epley | |
| 4,764,957 | A | 8/1988 | Angelini et al. | |
| 4,845,755 | A | 7/1989 | Busch et al. | |
| 4,862,509 | A | 8/1989 | Towsend | |
| 4,887,299 | A | 12/1989 | Cummins et al. | |
| 4,926,464 | A | 5/1990 | Schley-May | |
| 4,930,156 | A | 5/1990 | Norris | |
| 4,995,085 | A | 2/1991 | Kern et al. | |
| 5,010,575 | A | 4/1991 | Marutake et al. | |
| 5,027,410 | A | 6/1991 | Williamson et al. | |
| 5,086,464 | A | 2/1992 | Groppe | |
| 5,091,952 | A | 2/1992 | Williamson et al. | |
| 5,189,704 | A | 2/1993 | Krauss | |
| 5,212,827 | A | 5/1993 | Meszko et al. | |
| 5,280,524 | A | 1/1994 | Norris | |
| 5,321,758 | A | 6/1994 | Charpentier et al. | |
| 5,404,407 | A | 4/1995 | Weiss | |
| 5,422,628 | A | 6/1995 | Rodgers | |
| 5,425,104 | A | 6/1995 | Shennib | |
| 5,463,692 | A | 10/1995 | Fackler | |
| 5,524,056 | A | 6/1996 | Killion et al. | |
| 5,553,152 | A * | 9/1996 | Newton | 381/328 |
| 5,581,626 | A | 12/1996 | Palmer | |
| 5,629,985 | A | 5/1997 | Thompson | |
| 5,636,285 | A | 6/1997 | Sauer | |
| 5,640,293 | A | 6/1997 | Dawes et al. | |
| 5,640,457 | A | 6/1997 | Gnecco et al. | |
| 5,659,621 | A | 8/1997 | Newton | |
| 5,687,242 | A | 11/1997 | Iburg | |
| 5,706,351 | A | 1/1998 | Weinfurtner | |
| 5,710,820 | A | 1/1998 | Martin et al. | |
| 5,737,430 | A | 4/1998 | Widrow | |
| 5,740,257 | A | 4/1998 | Marcus | |
| 5,751,820 | A | 5/1998 | Taenzer | |
| 5,757,933 | A | 5/1998 | Preves et al. | |
| 5,768,397 | A | 6/1998 | Fazio | |
| 5,796,848 | A | 8/1998 | Martin | |
| 5,809,151 | A | 9/1998 | Husung | |
| 5,823,610 | A | 10/1998 | Ryan et al. | |
| 5,929,636 | A | 7/1999 | Torok et al. | |
| 5,991,420 | A | 11/1999 | Stern | |
| 6,031,922 | A | 2/2000 | Tibbetts | |
| 6,031,923 | A | 2/2000 | Gnecco et al. | |
| 6,054,780 | A | 4/2000 | Haigh et al. | |
| 6,078,675 | A | 6/2000 | Bowen-Nielsen et al. | |
| 6,101,258 | A | 8/2000 | Killion et al. | |
| 6,104,821 | A | 8/2000 | Husung | |
| 6,115,478 | A | 9/2000 | Schneider | |
| 6,118,877 | A | 9/2000 | Lindemann et al. | |
| 6,134,089 | A | 10/2000 | Barr et al. | |
| 6,148,087 | A | 11/2000 | Martin | |
| 6,157,727 | A | 12/2000 | Rueda | |
| 6,157,728 | A | 12/2000 | Tong et al. | |
| 6,310,556 | B1 | 10/2001 | Green et al. | |
| 6,324,291 | B1 | 11/2001 | Weidner | |
| 6,327,370 | B1 | 12/2001 | Killion et al. | |
| 6,356,741 | B1 | 3/2002 | Bilotti et al. | |
| 6,381,308 | B1 | 4/2002 | Cargo et al. | |
| 6,459,882 | B1 | 10/2002 | Palermo et al. | |
| 6,466,679 | B1 | 10/2002 | Husung | |
| 6,522,764 | B1 | 2/2003 | Bogeskov-Jensen | |
| 6,633,645 | B2 | 10/2003 | Bren et al. | |
| 6,760,457 | B1 | 7/2004 | Bren et al. | |
| 7,010,132 | B2 * | 3/2006 | Luo et al. | 381/312 |
| 7,016,511 | B1 | 3/2006 | Shennib | |
| 7,139,404 | B2 | 11/2006 | Feeley et al. | |
| 7,162,381 | B2 | 1/2007 | Boor et al. | |
| 7,248,713 | B2 | 7/2007 | Bren et al. | |
| 7,317,997 | B2 | 1/2008 | Boor et al. | |
| 7,369,671 | B2 | 5/2008 | Sacha et al. | |
| 8,218,804 | B2 | 7/2012 | Sacha et al. | |
| 8,259,973 | B2 | 9/2012 | Bren et al. | |
| 8,284,970 | B2 | 10/2012 | Sacha | |
| 8,433,088 | B2 | 4/2013 | Sacha et al. | |
| 2002/0094098 | A1 | 7/2002 | Delage | |
| 2002/0168130 | A1 | 11/2002 | Chaparala et al. | |
| 2003/0059073 | A1 | 3/2003 | Bren et al. | |
| 2004/0052391 | A1 | 3/2004 | Bren et al. | |
| 2004/0052392 | A1 | 3/2004 | Sacha et al. | |
| 2006/0013420 | A1 | 1/2006 | Sacha | |
| 2007/0121975 | A1 | 5/2007 | Sacha et al. | |
| 2007/0248237 | A1 | 10/2007 | Bren et al. | |
| 2008/0013769 | A1 | 1/2008 | Sacha et al. | |
| 2008/0199030 | A1 | 8/2008 | Sacha | |
| 2008/0199971 | A1 | 8/2008 | Tondra | |
| 2013/0216075 | A1 | 8/2013 | Sacha et al. | |
| 2013/0315423 | A1 | 11/2013 | Sacha et al. | |

FOREIGN PATENT DOCUMENTS

| | | | |
|---|---|---|---|
| DE | 3036417 | A1 | 5/1982 |
| DE | 3109049 | A1 | 9/1982 |
| DE | 3443907 | A1 | 6/1985 |
| DE | 3734946 | A1 | 5/1989 |
| DK | 1398995 | T3 | 8/2012 |
| EP | 1133236 | | 10/1966 |
| EP | 0031152 | A2 | 7/1981 |
| EP | 1196008 | A2 | 4/2002 |
| EP | 1398995 | A2 | 3/2004 |
| EP | 1174003 | B1 | 7/2004 |
| EP | 1484942 | A2 | 12/2004 |
| EP | 1398995 | B1 | 5/2012 |
| FR | 2714561 | A1 | 6/1995 |
| GB | 1254018 | | 11/1971 |
| JP | 918998 | A | 1/1997 |
| WO | WO-0223950 | A2 | 3/2002 |
| WO | WO-2006078586 | A2 | 7/2006 |
| WO | WO-2006078586 | A3 | 7/2006 |

OTHER PUBLICATIONS

U.S. Appl. No. 10/284,877, Final Office Action mailed Nov. 14, 2006, 11 pgs.

U.S. Appl. No. 10/284,877, Non Final Office Action mailed Mar. 25, 2005, 8 pgs.

U.S. Appl. No. 10/284,877, Non Final Office Action mailed Dec. 1, 2005, 10 pgs.

U.S. Appl. No. 10/284,877, Notice of Allowance mailed Mar. 22, 2007, 7 pgs.

U.S. Appl. No. 10/284,877, Response filed Mar. 1, 2006 to Non Final Office Action mailed Dec. 1, 2005, 17 pgs.

U.S. Appl. No. 10/284,877, Response filed Mar. 14, 2007 to Final Office Action mailed Nov. 14, 2006, 8 pgs.

U.S. Appl. No. 10/284,877, Response filed Jun. 27, 2005 to Non Final Office Action mailed Mar. 25, 2005, 15 pgs.

U.S. Appl. No. 10/284,877, Response filed Oct. 16, 2006 to Final Office Action mailed Jun. 14, 2006, 16 pgs.

U.S. Appl. No. 11/037,549, Advisory Action mailed Jun. 8, 2009, 3 pgs.

U.S. Appl. No. 11/037,549, Final Office Action mailed Sep. 20, 2010, 21 pgs.

U.S. Appl. No. 11/037,549, Non Final Office Action mailed Apr. 4, 2011, 22 pgs.

U.S. Appl. No. 11/037,549, Non-Final Office Action mailed Dec. 14, 2009, 25 pgs.

U.S. Appl. No. 11/037,549, Notice of Allowance mailed Feb. 21, 2012, 5 pgs.

(56) References Cited

OTHER PUBLICATIONS

U.S. Appl. No. 11/037,549, Notice of Allowance mailed Jun. 8, 2012, 5 pgs.
U.S. Appl. No. 11/037,549, Notice of Allowance mailed Oct. 24, 2011, 5 pgs.
U.S. Appl. No. 11/037,549, Response filed Feb. 22, 2011 to Final Office Action mailed Sep. 20, 2010, 11 pgs.
U.S. Appl. No. 11/037,549, Response filed May 26, 2009 to Final Office Action mailed Feb. 23, 2009, 11 pgs.
U.S. Appl. No. 11/037,549, Response filed Jun. 14, 2010 to Non Final Office Action mailed Dec. 14, 2009, 8 pgs.
U.S. Appl. No. 11/037,549, Response filed Jul. 5, 2011 to Non-Final Office Action mailed Apr. 4, 2011, 10 pgs.
U.S. Appl. No. 11/037,549, Response filed Nov. 23, 2009 Final Office Action mailed Feb. 23, 2009, 11 pgs.
U.S. Appl. No. 11/626,771, Non-Final Office Action mailed Sep. 17, 2010, 12 pgs.
U.S. Appl. No. 11/768,707, Non Final Office Action mailed Jan. 11, 2012, 20 pgs.
U.S. Appl. No. 11/768,707, Non Final Office Action mailed May 13, 2011, 15 pgs.
U.S. Appl. No. 11/768,707, Notice of Allowance mailed Jul. 10, 2012, 9 pgs.
U.S. Appl. No. 11/768,707, Response filed Apr. 11, 2012 to Non Final Office Action mailed Jan. 11, 2012, 10 pgs.
U.S. Appl. No. 11/768,707, Response filed Sep. 13, 2011 to Non-Final Office Action mailed May 13, 2011, 11 pgs.
U.S. Appl. No. 11/768,720 Non-Final Office Action mailed Oct. 25, 2010, 11 pgs.
U.S. Appl. No. 11/768,720, Notice of Allowance mailed Mar. 6, 2012, 8 pgs.
U.S. Appl. No. 11/768,720, Notice of Allowance mailed Jun. 10, 2011, 9 pgs.
U.S. Appl. No. 11/768,720, Notice of Allowance mailed Aug. 19, 2011, 8 pgs.
U.S. Appl. No. 11/768,720, Notice of Allowance mailed Dec. 23, 2011, 8 pgs.
U.S. Appl. No. 11/768,720, Response filed Mar. 7, 2011 to Non Final Office Action mailed Oct. 25, 2010, 10 pgs.
U.S. Appl. No. 12/107,643, Examiner Interview Summary mailed Jul. 19, 2012, 3 pgs.
U.S. Appl. No. 12/107,643, Final Office Action mailed Oct. 20, 2011, 9 pgs.
U.S. Appl. No. 12/107,643, Non Final Office Action mailed May 2, 2011, 10 pgs.
U.S. Appl. No. 12/107,643, Non Final Office Action mailed May 29, 2012, 8 pgs.
U.S. Appl. No. 12/107,643, Response filed Feb. 10, 2011 to Restriction Requirement mailed Jan. 10, 2011, 9 pgs.
U.S. Appl. No. 12/107,643, Response filed Mar. 20, 2012 to Final Office Action mailed Oct. 20, 2011, 11 pgs.
U.S. Appl. No. 12/107,643, Response filed Aug. 2, 2011 to Non-Final Office Action mailed May 2, 2011, 10 pgs.
U.S. Appl. No. 12/107,643, Restriction Requirement mailed Jan. 10, 2011, 9 pgs.
Canadian Application Serial No. 2,399,331, Response filed Feb. 7, 2006 to Office Action Aug. 8, 2005, 9 pgs.
Canadian Application Serial No. 2,439,329, Response filed Sep. 2, 2003 to Office Action Mar. 15, 2007, 24 pgs.
Canadian Application Serial No. 2,447,509, Office Action mailed Mar. 15, 2007, 4 pgs.
Canadian Application Serial No. 2,447,509, Office Action mailed Jul. 10, 2008, 5 pgs.
Canadian Application Serial No. 2,447,509, Voluntary Amendment filed Sep. 17, 2007, 29 pgs.
European Application Serial No. 01970730.6, Response filed Apr. 29, 2008 to Office Action mailed Oct. 16, 2007, 16 pgs.
European Application Serial No. 03255764.7, Office Action mailed Feb. 9, 2011, 9 pgs.
European Application Serial No. 03255764.7, Office Action Mailed May 19, 2010, 5 pgs.
European Application Serial No. 03255764.7, Office Action mailed Jun. 16, 2009, 4 pgs.
European Application Serial No. 03255764.7, Office Action mailed Oct. 6, 2009, 4 pgs.
European Application Serial No. 03255764.7, Response filed Apr. 16, 2010 to Office Action mailed Oct. 6, 2009, 66 pgs.
European Application Serial No. 03255764.7, Response filed Apr. 27, 2009 to Office Action mailed Oct. 16, 2008, 14 pgs.
European Application Serial No. 03255764.7, Response filed May 8, 2008 to Office Action mailed Jan. 2, 2008, 17 pgs.
European Application Serial No. 03255764.7, Response filed Oct. 10, 2011 to Office Action mailed Feb. 9, 2011, 9 pgs.
European Application Serial No. 03255764.7, Response filed Nov. 29, 2010 to Office Action mailed May 19, 2010, 10 pgs.
European Application Serial No. 03256897.4, European Search Report mailed Feb. 23, 2006, 3 pgs.
European Application Serial No. 03256897.4, Office Action mailed Aug. 16, 2007, 5 pgs.
European Application Serial No. 03256897.4, Office Action mailed Oct. 25, 2006, 6 pgs.
European Application Serial No. 03256897.4, Response filed Jan. 15, 2008 to Office Action mailed Aug. 16, 2007, 31 pgs.
European Application Serial No. 03256897.4, Response filed May 4, 2007 to Office Action mailed Oct. 25, 2006, 14 pgs.
European Application Serial No. 06718482.0, Office Action mailed Dec. 28, 2009, 4 pgs.
European Application Serial No. 06718482.0, Response filed Jun. 29, 2010 to Office Action mailed Dec. 28, 2009, 35 pgs.
Beck, L. B., "The "T" Switch; Some Tips for Effective Use", Shhh, (Jan./Feb. 1989), 12-15.
Gilmore, R., "Telecoils: past, present & future", Hearing Instruments, 44 (2), (1993), 22-23, 26-27, 40.
Hansaton Akustik GMBH, "48 K-AMP Contactmatic", (from Service Manual), (Apr. 1996), 8 pgs.
Lacanette, Kerry, "A Basic Introduction to Filters—Active, Passive, and Switched-Capacitor", National Semiconductor Corporation, http://www.swarthmore.edu/NatSci/echeeve1/Ref/DataSheet/Inttofilters.pdf, (Apr. 1991), 1-22.
Lybarger, S. F, "Development of a New Hearing Aid with Magnetic Microphone", Electrical Manufacturing, (Nov. 1947), 11 pgs.
Michael, J. C, et al., "A New Perspective on Magnetic Field Sensing", (May 1, 1998), 1-19.
Preves, D. A., "A Look at the Telecoil—Its Development and Potential", SHHH Journal, (Sep./Oct. 1994), 7-10.
Schaefer, Conrad, "Letter referencing Micro Ear Patent", (Aug. 22, 2002), 2 pgs.
Tondra, Mark, "Flow Assay With Integrated Detector", U.S. Appl. No. 60/887,609, filed Feb. 1, 2007, 28 pgs.
U.S. Appl. No. 09/659,214, Advisory Action mailed Jun. 2, 2003, 3 pgs.
U.S. Appl. No. 09/659,214, Final Office Action mailed Feb. 14, 2003, 7 pgs.
U.S. Appl. No. 09/659,214, Final Office Action mailed Mar. 19, 2003, 7 pgs.
U.S. Appl. No. 09/659,214, Non Final Office Action mailed Jul. 18, 2003, 7 pgs.
U.S. Appl. No. 09/659,214, Non Final Office Action mailed Sep. 6, 2002, 7 pgs.
U.S. Appl. No. 09/659,214, Notice of Allowance mailed Feb. 10, 2004, 6 pgs.
U.S. Appl. No. 09/659,214, Response filed May 19, 2003 to Final Office Action mailed Mar. 19, 2003, 9 pgs.
U.S. Appl. No. 09/659,214, Response filed Oct. 24, 2003 to Non Final Office Action mailed Jul. 18, 2003, 9 pgs.
U.S. Appl. No. 09/659,214, Response filed Nov. 12, 2002 to Non Final Office Action mailed Sep. 6, 2002, 10 pgs.
U.S. Appl. No. 10/214,045, 312 Amendment filed Jun. 12, 2003, 6 pgs.
U.S. Appl. No. 10/214,045, Non Final Office Action mailed Dec. 2, 2002, 7 pgs.

(56) References Cited

OTHER PUBLICATIONS

U.S. Appl. No. 10/214,045, Notice of Allowance mailed Apr. 8, 2003, 17 pgs.
U.S. Appl. No. 10/214,045, Response filed Apr. 2, 2003 to Non Final Office Action mailed Dec. 2, 2002, 8 pgs.
U.S. Appl. No. 10/244,295, Advisory Action mailed Nov. 1, 2006, 3 pgs.
U.S. Appl. No. 10/244,295, Final Office Action mailed May 24, 2007, 11 pgs.
U.S. Appl. No. 10/244,295, Final Office Action mailed Aug. 11, 2006, 9 pgs.
U.S. Appl. No. 10/244,295, Non Final Office Action mailed Feb. 3, 2006, 9 pgs.
U.S. Appl. No. 10/244,295, Non Final Office Action mailed Mar. 11, 2005, 10 pgs.
U.S. Appl. No. 10/244,295, Non Final Office Action mailed Nov. 29, 2006, 12 pgs.
U.S. Appl. No. 10/244,295, Notice of Allowance mailed Aug. 7, 2007, 7 pgs.
U.S. Appl. No. 10/244,295, Notice of Allowance mailed Dec. 21, 2007, 6 pgs.
U.S. Appl. No. 10/244,295, Response filed Jan. 28, 2005 to Restriction Requirement mailed Dec. 29, 2004, 1 pg.
U.S. Appl. No. 10/244,295, Response filed Feb. 28, 2007 to Non Final Office Action mailed Nov. 29, 2006, 16 pgs.
U.S. Appl. No. 10/244,295, Response filed May 3, 2020 to Non-Final Office Action mailed Feb. 3, 2006, 17 pgs.
U.S. Appl. No. 10/244,295, Response filed Jun. 13, 2005 to Non-Final Office Action mailed Mar. 11, 2005, 20 pgs.
U.S. Appl. No. 10/244,295, Response filed Jul. 24, 2007 to Final Office Action mailed May 24, 2007, 12 pgs.
U.S. Appl. No. 10/244,295, Response filed Oct. 11, 2006 to Final Office Action mailed Aug. 11, 2006, 17 pgs.
U.S. Appl. No. 10/244,295, Response filed Nov. 7, 2005 to Restriction Requirement mailed Oct. 5, 2005, 14 pgs.
U.S. Appl. No. 10/244,295, Response filed Nov. 13, 2006 to Advisory Action mailed Nov. 1, 2006, 19 pgs.
U.S. Appl. No. 10/244,295, Restriction Requirement mailed Oct. 5, 2005, 6 pgs.
U.S. Appl. No. 10/244,295, Restriction Requirement mailed Dec. 29, 2004, 5 pgs.
U.S. Appl. No. 10/244,295, Supplemental Notice of Allowance mailed Oct. 22, 2007, 2 pgs.
U.S. Appl. No. 11/037,549, Final Office Action mailed Feb. 23, 2009, 32 pgs.
U.S. Appl. No. 11/037,549, Non Final Office Action mailed Aug. 6, 2008, 22 pgs.
U.S. Appl. No. 11/037,549, Response filed Nov. 6, 2008 to Non Final Office Action mailed Aug. 6, 2008, 10 pgs.
U.S. Appl. No. 12/107,643, Notice of Allowance mailed Feb. 27, 2013, 9 pgs.
U.S. Appl. No. 12/107,643, Response filed Oct. 1, 2012 to Non Final Office Action mailed May 29, 2012, 10 pgs.
U.S. Appl. No. 13/873,031, Preliminary Amendment filed Sep. 3, 2013, 5 pgs.
Canadian Application Serial No. 2,339,331, Office Action mailed Aug. 8, 2005, 3 pgs.
Canadian Application Serial No. 2,439,329, Office Action mailed Mar. 15, 2007, 6 pgs.
Canadian Application Serial No. 2,439,329, Office Action Mailed Nov. 4, 2008, 4 pgs.
European Application Serial 01970730.6-2225, Office Action Oct. 16, 2007, 5 pgs.
European Application Serial No. 03255764.7, European Search Report mailed Sep. 18, 2007, 6 pgs.
European Application Serial No. 03255764.7, Office Action mailed Jan. 2, 2008, 3 pgs.
European Application Serial No. 03255764.7, Office Action Mailed Oct. 16, 2008, 5 pgs.
European Application Serial No. 03255764.7, Partial European Search Report mailed Apr. 13, 2007 (Bad), 4 pgs.
International Application Serial No. PCT/US01/28237, International Search Report mailed Jun. 21, 2002, 7 pgs.
International Application Serial No. PCT/US01/28237, Preliminary Report on Patentability mailed Mar. 7, 2003, 5 pgs.
International Application Serial No. PCT/US01/28237, Written Opinion mailed Nov. 26, 2002, 5 pgs.
International Application Serial No. PCT/US2006/001414, International Search Report mailed Dec. 29, 2006, 5 pgs.
International Application Serial No. PCT/US2006/001414, Preliminary Report on Patentability mailed Jul. 26, 2007, 7 pgs.
International Application Serial No. PCT/US2006/001414, Written Opinion mailed Dec. 29, 2006, 5 pgs.

* cited by examiner

INTEGRATED AUTOMATIC TELEPHONE SWITCH

CROSS-REFERENCE TO RELATED APPLICATIONS

This application is a continuation of U.S. patent application Ser. No. 11/768,707 tiled on Jun. 26, 2007, which is a continuation of 10/284,877 filed on 31 Oct. 2002, which is a continuation-in-part of U.S. patent application Ser. No. 09/659,214 filed on Sep. 11, 2000, now U.S. Pat. No. 6,760,457, which applications are herein incorporated by reference in their entirety.

FIELD OF THE INVENTION

This invention relates generally to hearing aids, and more particularly to an automatic switch for a hearing aid.

BACKGROUND

Hearing aids can provide adjustable operational modes or characteristics that improve the performance of the hearing aid for a specific person or in a specific environment, Some of the operational characteristics are volume control, tone control, and selective signal input. One way to control these characteristics is by a manually engagable switch on the hearing aid. For example, a telecoil used to electromagnetically pickup a signal from a telephone rather than acoustically is activated by a manual switch. However, it can be a drawback to require manual or mechanical operation of a switch to change the input or operational characteristics of a hearing aid. Moreover, manually engaging a switch in a hearing aid that is mounted within the ear canal is difficult, and may be impossible, for people with impaired finger dexterity.

In some known hearing aids, magnetically activated switches are controlled through the use of magnetic actuators, for examples see U.S. Pat. Nos. 5,553,152 and 5,659,621. The magnetic actuator is held adjacent the hearing aid and the magnetic switch changes the volume. However, such a hearing aid requires that a person have the magnetic actuator available when it desired to change the volume. Consequently, a person must carry an additional piece of equipment to control his\her hearing aid. Moreover, there are instances where a person may not have the magnetic actuator immediately present, for example when in the yard or around the house.

Once the actuator is located and placed adjacent the hearing aid, this type of circuitry for changing the volume must cycle through the volume to arrive at the desired setting. Such an action takes time and adequate time may not be available to cycle through the settings to arrive at the required setting, for example there may be insufficient time to arrive at the required volume when answering a telephone.

Some hearing aids have an input that receives the electromagnetic voice signal directly from the voice coil of a telephone instead of receiving the acoustic signal emanating from the telephone speaker. It may be desirable to quickly switch the hearing aid from a microphone (acoustic) input to a coil (electromagnetic field) input when answering and talking on a telephone. However, quickly manually switching the input of the hearing aid from a microphone to a voice coil may be difficult for some hearing aid wearers.

BRIEF DESCRIPTION OF THE DRAWINGS

A more complete understanding of the invention and its various features may be obtained from a consideration of the following detailed description, the appended claims, and the attached drawings.

DETAILED DESCRIPTION

In the following detailed description, reference is made to the accompanying drawings which form a part hereof and in which is shown by way of illustration embodiments in which the invention can be practiced, These embodiments are described in sufficient detail to enable those skilled in the art to practice and use the invention, and it is to be understood that other embodiments may be utilized and that electrical, logical, and structural changes may be made without departing from the spirit and scope of the present invention. The following detailed description is, therefore, not to be taken in a limiting sense and the scope of the present invention is defined by the appended claims and their equivalents.

A hearing aid is a hearing device that generally amplifies sound to compensate for poor hearing and is typically worn by a hearing impaired individual In some instances, the hearing aid is a hearing device that adjusts or modifies a frequency response to better match the frequency dependent hearing characteristics of a hearing impaired individual.

One embodiment of the present invention provides a method and apparatus for switching of a hearing aid input between an acoustic input and an electromagnetic field input. In one embodiment a method and an apparatus are provided for automatically switching from acoustic input to electromagnetic field input in the presence of the telephone handset.

In an embodiment, a hearing aid includes a microphone for receiving an acoustic signal and providing an electrical signal representative of the acoustic signal, a means for filtering the electrical signal and a means for automatic switching. The means for automatic switching responds to a change in detection of a magnetic field and upon detecting a presence of a magnetic field, enables the means for filtering the electrical signal such that a high frequency component of the electrical signal is modified. In an embodiment, a filtered low frequency component of the electrical signal is boosted in gain.

In another embodiment, a hearing aid includes a microphone electrical contact, an inductive element, a preamplifier coupled to the inductive element, and a control coupled to the switch. The preamplifier, the microphone electrical contact, the inductive element, and the control are integrated onto a single common circuit board.

Figure 1:
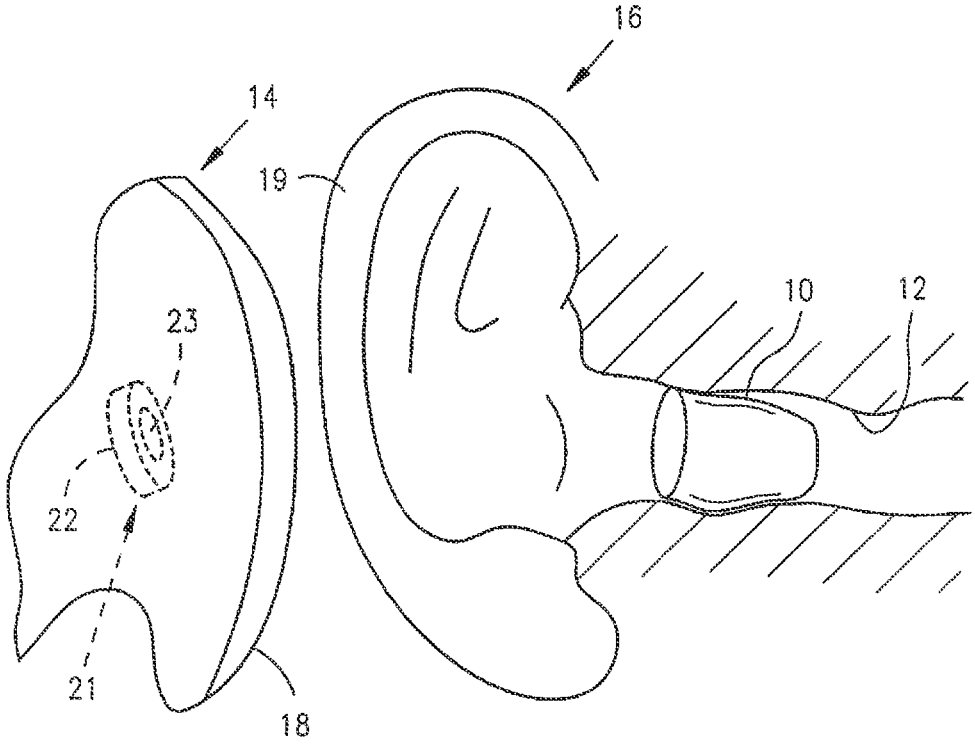
FIG. 1 illustrates an embodiment of a hearing aid adjacent a telephone handset, in accordance with the teachings of the present invention.

FIG. 1 illustrates a completely in the canal (CIC) hearing aid 10 which is shown positioned completely in the ear canal 12. A telephone handset 14 is positioned adjacent the ear 16 and, more particularly, the speaker 18 of the handset is adjacent the pinna 19 of ear 16. Speaker 18 includes an electromagnetic transducer 21 which includes a permanent magnet 22 and a voice coil 23 fixed to a speaker cone (not shown). Briefly, the voice coil 23 receives the time-varying component of the electrical voice signal and moves relative to the stationary magnet 22. The speaker cone moves with coil 23 and creates an audio pressure wave ("acoustic signal"). It has been found that when a person wearing a hearing aid uses a telephone it is more efficient for the hearing aid 10 to reduce background noise by picking up the voice signal from the magnetic field gradient produced by the voice coil 23 and not the acoustic signal produced by the speaker cone.

Figure 2:
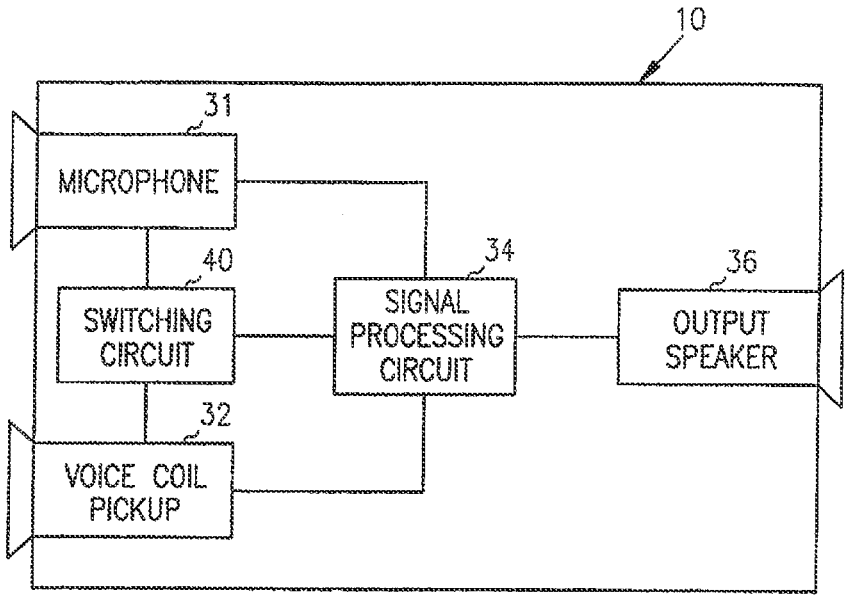
FIG. 2 is a schematic view of an embodiment of the FIG. 1 hearing aid, in accordance with the teachings of the present invention.

FIG. 2 is a schematic view of an embodiment of the FIG. 1 hearing aid 10 having two inputs, a microphone 31, and an induction coil 31 The microphone 31 receives acoustic signals, converts them into electrical signals and transmits same to a signal processing circuit 34. The signal processing circuit 34 provides various signal processing functions which can include noise reduction, amplification, and tone control. The signal processing circuit 34 outputs an electrical signal to an output speaker 36, which transmits audio into the wearer's ear. The induction coil 32 is an electromagnetic transducer that senses the magnetic field gradient produced by movement of the telephone voice coil 23 and in turn produces a corresponding electrical signal, which is transmitted to the signal processing circuit 34. Accordingly, use of the induction coil 32 eliminates two of the signal conversions normally necessary when a conventional hearing aid is used with a telephone, namely, the telephone handset 14 producing an acoustic signal and the hearing aid microphone 31 converting the acoustic signal to an electrical signal. it is believed that use of the induction coil reduces the background noise and acoustic feedback associated with a microphone signal that a user would hear from the hearing aid.

A switching circuit .40 is provided to switch the hearing aid input from the microphone 31, the default state, to the induction coil 32, the magnetic field sensing state. It is desired to automatically switch the states of the hearing aid 10 when the telephone handset 14 is adjacent the hearing aid wearer's ear. Thereby, the need fur the wearer to manually switch the input state of the hearing aid when answering a telephone call and after the call is eliminated. Finding and changing the state of the switch on a miniaturized hearing aid can be difficult especially when under the time constraints of a ringing telephone.

Figure 3:
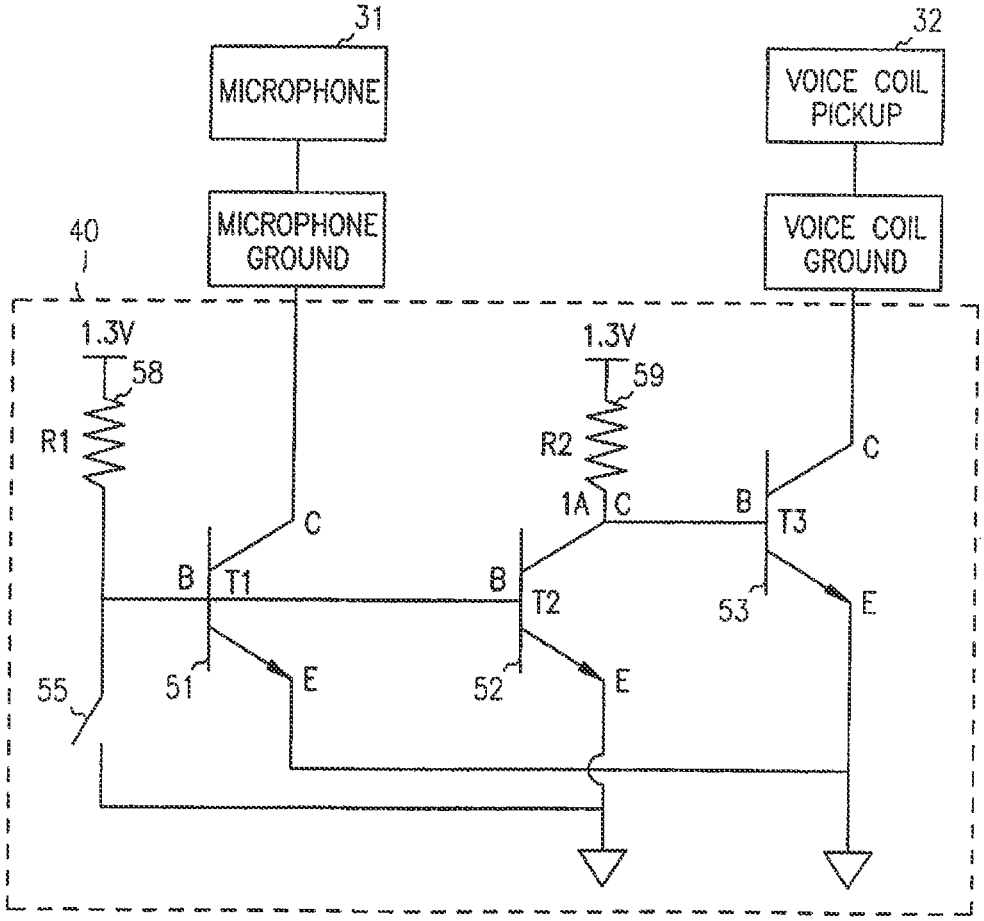
FIG. 3 shows a diagram of an embodiment of the switching circuit of FIG. 2, in accordance with the teachings of the present invention.

The switching circuit 40 of the described embodiment changes state when in the presence of the telephone handset magnet 22 which produces a constant magnetic field that switches the hearing aid input from the microphone 31 to the induction coil 32. As shown in FIG. 3, the switching circuit 40 includes a microphone activating first switch 51, here shown as a transistor that has its collector connected to the microphone ground, base connected to a hearing aid voltage source through a resistor 58, and emitter connected to ground. Thus, the default state of hearing aid 10 is switch 58 being on and the microphone circuit being complete. A second switch 52 is also shown as a transistor that has its collector connected to the hearing aid voltage source through a resistor 59, base connected to the hearing aid voltage source through resistor 58, and emitter connected to ground. An induction coil activating third switch 53 is also shown as a transistor that has its collector connected to the voice pick up ground, base connected to the collector of switch 52 and through resistor 59 to the hearing aid voltage source, and emitter connected to ground. A magnetically activated fourth switch 55 has one contact connected to the base of first switch 51 and through resistor 58 to the hearing aid voltage source, and the other contact is connected to ground. Contacts of switch 55 are normally open.

In this default open state of switch 55, switches 51 and 52 are conducting. Therefore, switch 51 completes the circuit connecting microphone 31 to the signal processing circuit 34. Switch 52 connects resistor 59 to ground and draws the voltage away from the base of switch 53 so that switch 53 is open and not conducting. Accordingly, hearing aid 10 is operating with microphone 31 active and the induction coil 32 inactive.

Switch 55 is closed in the presence of a magnetic field, particularly in the presence of the magnetic field produced by telephone handset magnet 22. In one embodiment of the invention, switch 55 is a reed switch, for example a micro-miniature reed switch, type HSR-003 manufactured by Hermetic Switch, Inc. of Chickasha, Okla. When the telephone handset magnet 22 is close enough to the hearing aid wearer's ear, the magnetic field produced by magnet 22 closes switch 55. Consequently, the base of switch 511 and the base of switch 52 are now grounded. Switches 51 and 52 stop conducting and microphone ground is no longer grounded. That is, the microphone circuit is open. Now switch 52 no longer draws the current away from the base of switch 53 and same is energized by the hearing aid voltage source through resistor 59. Switch 53 is now conducting. Switch 53 connects the induction coil ground to ground and completes the circuit including the induction coil 32 and signal processing circuit 34.

In usual operation, switch 55 automatically closes and conducts when it is in the presence of the magnetic field produced by telephone handset magnet 22. This eliminates the need for the hearing aid wearer to find the switch, manually change switch state, and then answer the telephone. The wearer can conveniently merely pickup the telephone handset and place it by his\her ear whereby hearing aid 10 automatically switches from receiving microphone (acoustic) input to receiving pickup coil (electromagnetic) input. Additionally, hearing aid 10 automatically switches back to microphone input after the telephone handset 14 is removed from the ear. This is not only advantageous when the telephone conversation is complete but also when the wearer needs to talk with someone present (microphone input) and then return to talk with the person on the phone (induction coil input).

While the disclosed embodiment references an in-the-ear hearing aid, it will be recognized that the inventive features of the present invention are adaptable to other styles of hearing aids including over-the-ear, behind-the-ear, eye glass mount, implants, body worn aids, etc. Due to the miniaturization of hearing aids, the present invention is advantageous to many miniaturized hearing aids.

An example of an induction coil used in a hearing aid is a telecoil. The use of a telecoil addresses other problems associated with using a received acoustic signal from a microphone. Because of the proximity of the telephone handset to the hearing aid, an acoustic feedback loop can be formed that may result in oscillation or a squealing sound as that often heard with public address systems. Use of the telecoil eliminates these acoustic feedback problems and room noise.

However, the telecoil takes up additional space that may preclude its use in smaller model custom hearing aids. Other embodiments for automatic switching in conjunction with using a telephone or other communication device can address the space problems associated with a voice pickup coil such as a telecoil.

Further problems associated with acoustic coupling of signals from the telephone handset to the hearing aid include creating a leakage path that allows low frequency signals to leak away in the air due to the telephone handset not held tightly to the hearing aid microphone.

In an embodiment for microphone pick up of an acoustic signal, acoustic feedback oscillation is substantially reduced by reducing a high frequency gain of the hearing aid so as to limit the frequency response in the region of the acoustic feedback oscillation. The high frequency component is attenuated to also reduce circuit noise and environmental electromagnetic interference. In an embodiment, gain in the frequency range for which speech energy has a maximum energy is boosted, while gain for frequencies outside this range is attenuated. Thus, a high frequency component of a signal is the frequency components greater than a specific frequency or roll-off frequency for which speech energy is decreasing as the frequency increases. In one embodiment, the gain is substantially reduced at frequencies larger than about 3 kHz. In another embodiment, the gain is substantially reduced at frequencies less than about 200 Hz and at frequencies greater than about 1000 Hz, Further, gain is boosted at frequencies in the range from about 200 Hz to about 1000 Hz. In another embodiment, the gain is boosted ranging from about 300 Hz to about 1000 Hz, while attenuating the signal for frequencies outside this range. Alternately, the high frequency component is substantially reduced while boosting the gain for the low frequency without boosting the signal below 300 Hz. Typically, a telephone does not pass signals with a frequency below 300 Hz. Reducing the high frequency component can be accomplished several embodiments described herein for a hearing aid with or without a telecoil. By using embodiments without a telecoil considerable space savings can be gained in the hearing aid. Such hearing devices can be hearing aids for use in the ear, in the ear canal, and behind the ear.

In an embodiment, a method for operating a hearing aid can include receiving an acoustic signal having a low frequency component and a high frequency component, providing an electrical signal representative of the acoustic signal, where the electrical signal has a corresponding low frequency component and a high frequency component, and filtering the electrical signal, in response to detecting a presence of a magnetic field, to modify the high frequency component of the electrical signal. In one embodiment, the method can further include boosting a gain for the low frequency component substantially concurrent with modifying the high frequency component, Further, filtering the electrical signal to modify the high frequency component can include filtering the electrical signal using a low pass fitter. Alternately, filtering the electrical signal to modify the high frequency component and/or low frequency component can include switching from a set of stored parameters to another set of stored parameters to modify a frequency response of a programmable analog hearing aid. In another embodiment, filtering the electrical signal to modify the high frequency component and/or low frequency component can include digitally modifying a frequency response of the hearing aid. In one embodiment, modifying an electrical signal representing an acoustic signal can include receiving the electrical signal and regenerating the electrical signal with the signal in a predetermined frequency band boosted in gain and the other frequencies substantially reduced. In an embodiment, modifying an electrical signal can include attenuating the signal in a selected frequency range which can include all frequencies greater than a predetermined frequency. Alternately, modifying an electrical signal representative of an acoustic signal can include boosting a gain for a selected frequency range of the electrical signal. In each of these embodiments, detecting a presence of a magnetic field can include detecting the presence of the magnetic field using a reed switch. Alternately, the presence of a magnetic field can be detected using Hall effect semiconductors, magneto-resistive sensors, or saturable core devices.

Figure 4:
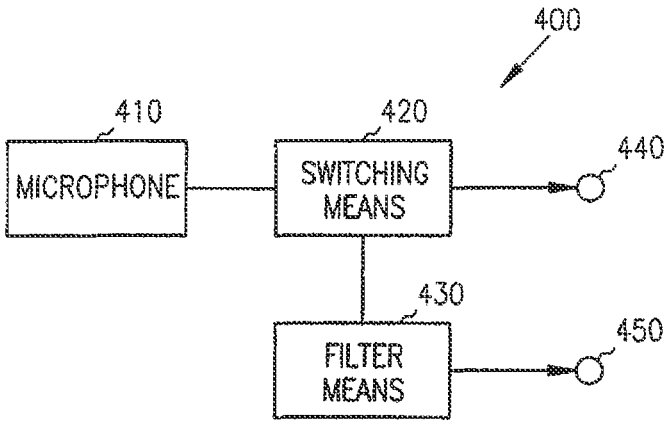
FIG. 4 shows a block diagram of an embodiment of a hearing aid having a. microphone, a switching means, and a filter means, in accordance with the teachings of the present invention.

FIG. 4 shows a block diagram of an embodiment of a hearing aid 400 having a microphone 410, a switching means 420, and a filter means 430. Switching means 420 provides for an unfiltered signal at node 440 or a filtered signal at node 450. Subsequent processing of the unfiltered signal after node 440 may include filtering for noise reduction, acoustic feedback reduction, tone control, and other signal processing operations to provide a clear audible sound for an individual using the hearing aid.

Microphone 410 is configured to receive an acoustic signal having a low frequency component and a high frequency component, and to provide an electrical signal representative of the received acoustic signal. The acoustic signal can be generated from a variety of sources. When the acoustic signal is generated from the receiver of a telephone, an associated magnetic field is produced by the telephone. Other communication devices can also provide a magnetic field associated with the acoustic signal from the communication device.

Switching means 420 is responsive to the magnetic field. In one embodiment, switching means 420 closes a switch, i.e., completes a conductive path between two conductive terminals, upon detecting the presence of a magnetic field. Upon removal of the magnetic field switching means 420 opens a switch, i.e., removes the conductive path between two conductive terminals. Switching means 420 provides for switching between possible circuit paths upon the presence and removal of a magnetic field. Such presence or removal is associated with a threshold magnetic field for detecting a presence of a magnetic field. Switching means 420 can include a reed switch or other magnetic sensor such as a Hall effect semiconductors, magneto-resistive sensors, saturable core devices, and other magnetic solid device sensors.

In an embodiment, upon detecting a presence of a magnetic field, switching means 420 automatically switches to enable filter means 430 to modify the high and/or low frequency component of the electrical signal. The filtered electrical signal includes a representation of the low frequency component of the electrical signal and is provided at node 450 for further processing. Upon the removal of the magnetic field, switching means 420 automatically switches to enable the unfiltered electrical signal to pass to node 440 for further processing. Node 440 and node 450 can be the same node, where an electrical signal representative of an acoustic signal, whether it is an unfiltered signal having a tow and a high frequency component or a filtered signal having primarily a low frequency component, is further processed. The further processing can include amplification, filtering for noise control, acoustic feedback reduction, and tone control, and other signal processing to provide a clear audible signal.

In an embodiment, filter means 430 provides apparatus for modifying the frequency response of hearing aid 400 to substantially reduce a high frequency component of an electrical signal to be provided to a speaker. Filter means can include, but is not limited to, low pass fitters including analog and digital filters, means for switching signal processor parameters that modify a frequency response, means for boosting a gain of a low frequency component, or means for digitally modifying a frequency response of the hearing aid.

Figure 5:
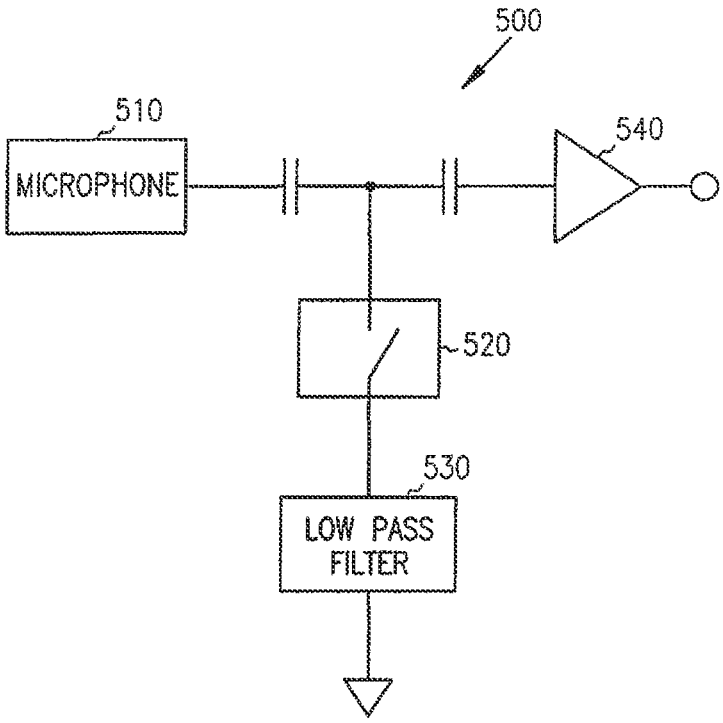
FIG. 5 shows a block diagram of an embodiment of a hearing aid having a microphone, a switch, and lowpass filter, in accordance with the teachings of the present invention.

FIG. 5 shows a block diagram of an embodiment o a hearing aid 500 having a microphone 510, a switch 520, and a low pass filter 530. An acoustic signal having a low frequency component and a high frequency component is received by microphone 510. Microphone provides an electrical signal representative of the received acoustic signal, which is capacitively coupled to a signal processing unit 540. In one embodiment, signal processing unit 540 is followed by a class D amplifier. In another embodiment, signal processing unit 540 includes an amplifier and conventional signal processing devices to provide a signal to a speaker for generating an audible sound representative of the acoustic signal received by microphone 510.

In an embodiment, switch 520 is a magnetic sensor, which provides for switching between possible circuit paths upon the presence and removal of a magnetic field. The magnetic sensor can be a reed switch. Alternately, the magnetic sensor can be selected from a group of magnetic sensors that can be configured as a switch such as Hall effect semiconductors, magneto-resistive sensors, saturable core devices, and other magnetic solid state sensors. Upon detection of the presence of a magnetic field, switch 520 closes to couple low pass filter 530 to a node in the signal path from microphone 510 to signal processing unit 540. Low pass filter 530 substantially reduces the high frequency component of the electrical signal representing the acoustic signal from reaching signal processing unit 540. As is understood by those skilled in the art, low pass fitter 530 may be a passive filter or an active filter. Though not shown in any figure, after appropriate signal processing, a representative output signal of a received acoustic signal is provided to a speaker for output.

Upon removal of the magnetic field, switch 520 opens uncoupling low pass filter 530 from the signal path from microphone 510 to signal processing unit 540. The electrical signal representative of the received acoustic signal of handset to hearing aid passes to signal processing unit 540 containing its high frequency component and its low frequency component. The removal of the magnetic field occurs when a telephone or other communication device producing a magnetic field in conjunction with producing an acoustic signal is removed from proximity to the hearing aid. With the telephone or other communication device removed from proximity of the hearing aid, acoustic signals received are substantially representative of the sounds of the local environment of the hearing aid.

Figure 6:
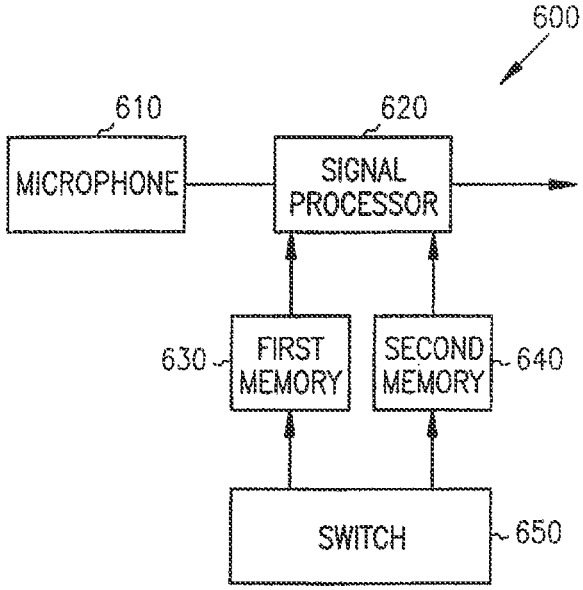
FIG. 6 shows a block diagram of an embodiment of a hearing aid having a microphone providing an input to a signal processor whose parameters are controlled by a first memory and a second memory, in accordance with the teachings of the present invention.

FIG. 6 shows a block diagram of an embodiment of a hearing aid 600 having a microphone 610 providing an input to a signal processor 620 whose parameters are controlled by a first memory 630 and a second memory 640. Microphone 610 receives an acoustic signal having a low frequency component and a high frequency component. An electrical signal representative of the acoustic signal is passed from microphone 610 to signal processor 620, where signal processor 620 modifies the electrical signal and provides an output signal representative of the acoustic signal to a speaker. The modifications made by signal processor 620 can include amplification, acoustic feedback reduction, noise reduction, and tone control, among other signal processing functions as are known to those skilled in the art.

First memory 630 is adapted to provide standard parameters for operating hearing aid 600. These parameters are used by signal processor 620 to modify the electrical signal representing the received acoustic signal including the low frequency response and the high frequency response of hearing aid 600 to provide an enhanced signal to a hearing aid speaker, These parameters allow signal processor 620 to modify a frequency response conforming to a prescription target such as FIG. 6, NAL-NL-1, or DST for standard operation of hearing aid 600 in its local environment, These prescription targets are known to those skilled in the art.

Second memory 640 is adapted to provide parameters for operating hearing aid 600 in conjunction with a telephone or other audio providing communication device used in proximity to hearing aid 600. These parameters are used by signal processor 620 to modify a frequency response of hearing aid 600 by boosting a low frequency gain and reducing a high frequency gain. In one embodiment, the high frequency gain is reduced such as to substantially reduce the high frequency component of the electrical signal representing the received acoustic signal.

The parameters used by signal processor 620 are provided by switch 650. Switch 650 is configured to provide a control signal in response to detecting a presence of a magnetic field. The presence of the magnetic field can correspond to a threshold level at switch 650, above which a magnetic field is considered present and below which a magnetic field is considered not to be present or considered to be removed. Upon determining the presence of the magnetic field, switch 650 provides a control signal that enables second memory 640 to provide parameters to the signal processor 620. When the magnetic field is removed, or when there is no magnetic field, switch 650 provides a control signal that enables first memory 630 to provide parameters to signal processor 620. In one embodiment, the control signal is the closing or opening of a path which enables one of first memory 630 and second memory 640 to provide its parameters to signal processor 620.

In FIG. 6, first memory 630 and second memory 640 are coupled to and provide parameters to signal processor 620 upon being enabled by switch 650. First memory 630 and second memory 640 can be coupled to signal processor 620 by a common bus, where switch 650 enables the placing of data, representing parameters from first memory 630 or second memory 640, onto the common bus. Alternately, switch 650 can be coupled to signal processor 620 and first and second memories 630, 640, where the parameters are provided to signal processor 620 through switch 650 from memories 630, 640, depending on the presence or absence of a magnetic field.

Switch 650 can be configured o use a magnetic sensor, which provides for switching between possible circuit paths upon the presence and removal of a magnetic field. The magnetic sensor can be a reed switch. Alternately, the magnetic sensor can be selected from a group of magnetic sensors that can be configured as a switch such as Hall effect semiconductors, magneto-resistive sensors, saturable core devices, and other magnetic solid state sensors.

In one embodiment, hearing aid 600 can be a programmable analog hearing aid having multiple memory storage capability. The parameters sent to signal processor 620 set the operating levels and device characteristics of the analog devices of hearing aid 600 for modifying an electrical version of the acoustic signal received at microphone 610.

In another embodiment, hearing aid 600 can be a digital hearing aid having memory storage capability. The parameters sent to signal processor 620 set the operating levels and device characteristics of the analog devices of hearing aid 600 for modifying an electrical version of the acoustic signal received at microphone 610.

Signal processor 620 digitally modifies the frequency response of hearing aid 600, according to parameters stored in memory, to match the frequency characteristics of the individual using the hearing aid. This modification can include amplification, digital filtering, noise reduction, tone control, and other digital signal processing for a hearing aid as known by those skilled in the art.

The embodiments described herein for a hearing aid with filtering means to modify the high frequency component of an electrical signal representative of an acoustic signal can be applied to a hearing aid with or without a telecoil. With a telecoil, a common switch responsive to a magnetic field can be used to switch in both the telecoil and an embodiment for the filtering means. Using the embodiments without a telecoil requires less space and provides for smaller hearing aids that do not require additional circuit boards or circuit packages for mounting and coupling to the telecoil and the associated control circuitry of the telecoil. However, in an embodiment of a hearing aid, telecoil support electronics without such filter means can be integrated with necessary electronic elements on a single common circuit board.

In various embodiments, a switch responsive to a magnetic field activates circuitry to modify an electrical signal representative of a received acoustic signal. On detecting the presence of the magnetic field, the switch enables part of a circuit similar to FIG. 3 in which the switch functions in conjunction with a transistor switch to enable the modification circuitry. When the presence of the magnetic field is not detected, that is, no magnetic field is present or one with a magnetic field strength less than a predetermined threshold is present, the switch functions in conjunction with another transistor switch, where the modification circuitry is not enabled and the electrical signal representative of the received acoustic signal is passed on to the next stage of processing without significant modification.

The transistor switches can be bipolar transistors, metal oxide semiconductor transistors, or other solid state transistors. Further, the modification circuitry can include means for boosting a low frequency component of an electrical signal and/or attenuating a high frequency component of the electrical signal, or other modification of the electrical signal as previously discussed in different embodiments for a hearing aid.

Further, the switch responsive to the magnetic field can be configured to use a magnetic sensor, which provides for switching between possible circuit paths upon the presence and removal of a magnetic field. The magnetic sensor can be a reed switch. Alternately, the magnetic sensor can be selected from a group of magnetic sensors that can be configured as a switch such as Hall effect semiconductors, magneto-resistive sensors, saturable core devices, and other magnetic solid state sensors.

Figure 7:
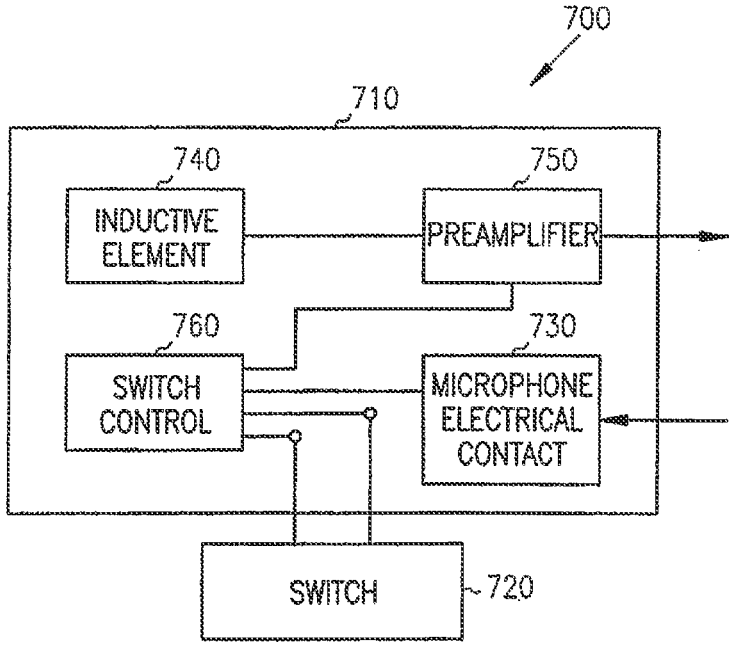
FIG. 7 shows a block diagram of an embodiment of a single circuit board providing integrated coupling of elements with a switch of a hearing aid, in accordance with the teachings of the present invention.

FIG. 7 shows a block diagram of an embodiment of a single circuit board 710 providing integrated coupling of elements with a switch 720 of a hearing aid 700. Circuit board 710 can include a microphone electrical contact 730, an inductive element 740, a preamplifier 750 coupled to inductive element 740, and a switch control 760. Circuit board 710 has two electrical contacts coupled to switch 720 responsive to a magnetic field. Switch control 760 energizes a circuit that includes inductive element 740 in response to detecting a magnetic field, while de-energizing a microphone circuit that includes microphone electrical contact 730. Microphone electrical contact 730, inductive element 740, preamplifier 750, and switch control 760 are integrated onto the single circuit board 710. Integrating these elements onto circuit board 710 conserves space and increases the reliability of hearing aid 700. Use of circuit board 710 enables hearing aid to be smaller than conventional hearing aids incorporating a telecoil.

Switch 720 can include a magnetic sensor configured as a switch. The magnetic sensor can be a reed switch. Alternately, the magnetic sensor can be selected from a group of magnetic sensors that can be configured as a switch such as Hall effect semiconductors, magneto-resistive sensors, saturable core devices, and other magnetic solid state sensors. Switch 720 is configured to have a magnetic field threshold related to use of a telephone or other communication device in proximity to the hearing aid.

Inductive element 740 can be an inductive coil providing an electrical input to preamplifier 750 that is representative of an acoustic signal in a telephone or other communication device producing a corresponding electromagnetic signal. In an embodiment, inductive element 740 is a telecoil, Further, preamplifier 750 is adapted to set a sensitivity of inductor element 740 to that of a hearing aid microphone.

Switch control 760 produces the necessary circuitry to use switch 720 configured to switch between providing an input to signal processing devices of hearing aid 700 from inductive element 740/preamplifier 750 or from a microphone circuit including microphone electrical contact 730. Microphone electrical contact 730 can be an input pin on circuit board 710 or a conductive node on circuit board 710.

Figure 8:
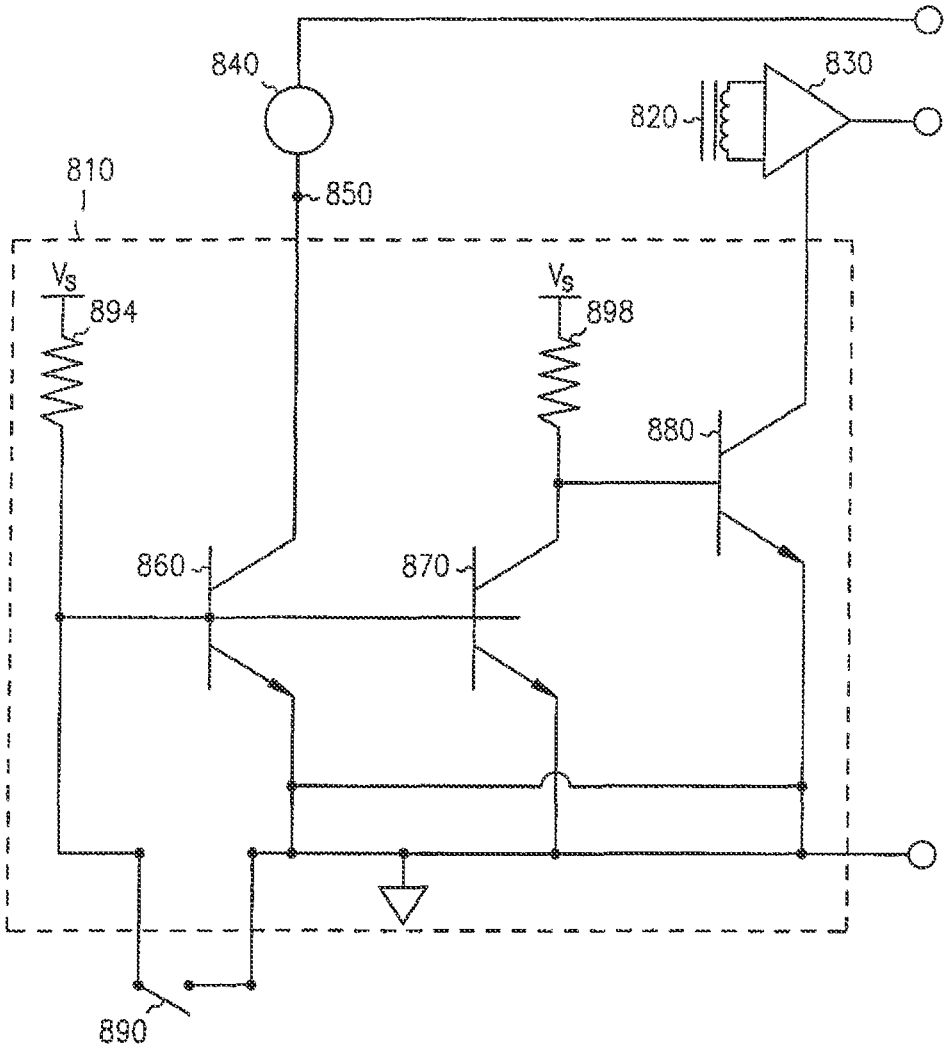
FIG. 8 shows an embodiment of a switch control for a switch that is integrated on a circuit board with an inductive element and a preamplifier, in accordance with the teachings of the present invention.

In one embodiment preamplifier 750 and microphone electrical contact 730 are integrated on circuit board 710 with microphone electrical contact 730, inductive element 740, and switch control 760 that are arranged as circuit elements as described with respect to FIG. 3. In one embodiment, switch control 760 includes a transistor switch for the microphone and a transistor switch for the inductive element, FIG. 8 shows an embodiment of a switch control 810 for a switch 890, where switch control 810 is integrated on a circuit board with an inductive element 820 and a preamplifier 830. A microphone 840 is included in the circuit shown in FIG. 8, but is not integrated on the circuit board. Input from microphone 840 is provided at the circuit board at microphone electrical contact 850. Switch control 810 includes three transistor switches 860, 870, 880. The base of transistor switch 860 and the base of transistor 870 are coupled to a power source, $V_S$, by resistor 894, white the collector of transistor 870 and the base of transistor 880 are coupled to $V_S$ through resistor 898. Power source, $V_S$, can have a typical value of about 1.3V. The power source for microphone 840 and preamplifier 830 is not shown in FIG. 8, The bases of transistors 860, 870 are also coupled to switch 890, included in the circuit shown in FIG. 9 but not integrated on the circuit board, having a lead coupled to ground.

When switch 890 is open, transistors 860, 870 are on, energizing a circuit containing microphone 840 and de-energizing a circuit containing inductor element 820. When switch 890 is closed, transistor 880 is on, energizing a circuit containing inductor element 820/preamplifier 830 and de-energizing a circuit containing microphone 840. Switch 890 opens and closes in respond to detecting the presence of a magnetic field. In one embodiment, switch 890 is a reed switch. Alternately, switch 890 can be a magnetic sensor selected from a group consisting of Hall effect semiconductors, magneto-resistive sensors, saturable core devices, and other magnetic solid state sensors. In another embodiment, switch control 810 uses transistor switches that include metal oxide semiconductor (MOS) transistors for opening and closing appropriate circuits.

A hearing aid with switching means and filtering means can be constructed that provides enhanced operation when using a telephone or other audio communication device. In an embodiment, the switching means, upon detecting the presence of a magnetic field, enables the filtering means to modify the frequency response of the hearing aid to increase a low frequency gain and reduce a high frequency gain, Alternatively, modifying the high frequency gain includes substantially reducing or attenuating a high frequency component of an electrical signal representative of an acoustic signal received by a microphone of the hearing aid, Such a hearing aid substantially reduces acoustic feedback oscillation by reducing the high frequency gain so as to limit the frequency response in the region of the acoustic feedback oscillation. A hearing aid including the switching means and the filtering means can also be constructed incorporating the use of a telecoil. However, by using embodiments without a telecoil considerable space savings can be gained in the hearing aid. Such hearing devices can be hearing aids for use in the ear, in the ear canal, and behind the ear.

For hearing aids incorporating a telecoil, an embodiment provides a hearing aid using less space. Such a hearing aid can include a switch responsive to a magnetic field coupled to a single circuit board having a microphone electrical contact, an inductive element, and a switch control. Integrating these elements onto a single circuit board conserves space and increases reliability of the hearing aid. Use of such a circuit board enables the hearing aid to be smaller than conventional hearing aids incorporating a telecoil. Using the telecoil in conjunction with a switch responsive to a magnetic field provides for automatic switching to operate the hearing aid without the general problems associated with the acoustic signal received by the microphone of a typical hearing aid.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A method comprising:

sensing an acoustic signal using a microphone in a hearing assistance device;

producing an electrical signal representative of the acoustic signal using the microphone;

processing the electrical signal using a signal processor in the hearing assistance device;

detecting a presence of a magnetic field at a programmable threshold produced by a voice communication device using a magnetic sensor disposed in the hearing assistance device;

in response to the detection of the presence of the magnetic field, automatically modifying the processing of the electrical signal by the signal processor conforming to a prescription target; and in response to the magnetic sensor determining removal of the magnetic field, further automatically modifying the processing of the electrical signal by the signal processor.

2. The method of claim 1, wherein modifying the processing in response to the detection of the presence of the magnetic field includes attenuating high frequencies in the electrical signal.

3. The method of claim 1, wherein modifying the processing in response to the detection of the presence of the magnetic field includes adjusting amplification.

4. The method of claim 1, wherein modifying the processing in response to the detection of the presence of the magnetic field includes adjusting noise reduction.

5. The method of claim 1, wherein modifying the processing in response to the detection of the presence of the magnetic field includes adjusting digital filtering.

6. The method of claim 1, wherein detecting a presence of a magnetic field includes using a solid state sensor.

7. The method of claim 1, wherein detecting a presence of a magnetic field includes using a Hall effect semiconductor.

8. The method of claim 1, wherein detecting a presence of a magnetic field includes using a saturable core device.

9. The method of claim 1, wherein detecting a presence of a magnetic field includes using a magneto-resistive sensor.

10. The method of claim 1, wherein the voice communication device includes a phone.

11. A hearing assistance device, comprising:

a microphone configured to sense an acoustic signal and to provide an electrical signal representative of the acoustic signal;

a signal processor configured to process the electrical signal for hearing correction for a wearer of the hearing assistance device; and a magnetic sensor configured to detect a presence of a magnetic field at a programmable threshold produced by a voice communication device, wherein the signal processor is configured to automatically modify the processing of the electrical signal conforming to a prescription target in response to the detection of the presence of the magnetic field and to further modify the processing of the electrical signal in response to the magnetic sensor determining removal of the presence of the magnetic field.

12. The hearing assistance device of claim 11, wherein the magnetic sensor includes a solid state sensor.

13. The hearing assistance device of claim 11, wherein the magnetic sensor includes a hall effect semiconductor.

14. The hearing assistance device of claim 11, wherein the magnetic sensor includes a saturable core device.

15. The hearing assistance device of claim 11, wherein the magnetic sensor includes a magneto-resistive sensor.

16. The hearing assistance device of claim 11, wherein the hearing assistance device includes a hearing aid.

17. The hearing assistance device of claim 16, wherein the hearing aid includes a behind the ear hearing aid.

18. The hearing assistance device of claim 16, wherein the hearing aid includes an in the ear hearing aid.

19. The hearing assistance device of claim 16, wherein the hearing aid includes an in the canal hearing aid.

20. The hearing assistance device of claim 16, wherein the hearing aid includes an implanted hearing aid.

* * * * *